US006257572B1

(12) United States Patent
Yamada et al.

(10) Patent No.: US 6,257,572 B1
(45) Date of Patent: Jul. 10, 2001

(54) IMAGE FORMING APPARATUS HAVING SHEET POST-PROCESSING UNIT

(75) Inventors: Kou Yamada; Yuuji Takarabe, both of Toyohashi; Shinji Matsumoto, Sakai, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/390,687

(22) Filed: Sep. 7, 1999

(30) Foreign Application Priority Data

Sep. 7, 1998 (JP) ..... 10-255770

(51) Int. Cl.[7] ..... B65H 39/10

(52) U.S. Cl. ..... 271/305; 271/279; 271/287; 271/289; 271/292; 271/297; 271/298; 271/303

(58) Field of Search ..... 271/279, 287, 271/289, 292, 297, 298, 303, 305

(56) References Cited

U.S. PATENT DOCUMENTS

| | | | | |
|---|---|---|---|---|
| 4,285,607 | * | 8/1981 | Steinhilber | 400/625 |
| 4,569,582 | * | 2/1986 | Hyltoft | 399/77 |
| 4,691,914 | * | 9/1987 | Lawrence | 271/297 |
| 4,819,931 | * | 4/1989 | Goto et al. | 271/287 |
| 4,849,790 | * | 7/1989 | Ito | 399/367 |
| 5,095,371 | * | 3/1992 | Tanaka et al. | 358/300 |
| 5,154,411 | * | 10/1992 | Saito et al. | 271/289 |
| 5,204,727 | * | 4/1993 | Haneda et al. | 399/405 |
| 5,267,729 | * | 12/1993 | Hirota et al. | 271/297 |
| 5,331,389 | * | 7/1994 | Fukuchi et al. | 399/403 |
| 5,346,205 | * | 9/1994 | Lawrence | 271/297 |
| 5,501,449 | * | 3/1996 | Olexy et al. | 271/292 |
| 5,788,229 | * | 8/1998 | Asami et al. | 271/305 |
| 5,956,160 | * | 9/1999 | Watanabe | 358/496 |
| 5,999,765 | * | 12/1999 | Tomita | 399/69 |
| 6,003,865 | * | 12/1999 | Hayashi | 271/287 |

FOREIGN PATENT DOCUMENTS

| | | |
|---|---|---|
| 62-201775 | 9/1987 | (JP) . |
| 63-160972 | 7/1988 | (JP) . |
| 08208108 | 8/1996 | (JP) . |

* cited by examiner

*Primary Examiner*—Robert P. Olszewski
*Assistant Examiner*—Richard Ridley
(74) *Attorney, Agent, or Firm*—McDermott, Will & Emery

(57) ABSTRACT

An image forming apparatus comprises a main body and a sheet post-processing unit. The main body has a first discharge path, a second discharge path, a first mounting portion and a second mounting portion. The sheet post-processing unit has a first sheet receiving path and a second sheet receiving path each connecting to a common sheet transport path, a first mounting portion and a second mounting portion. The first discharge path is connected to the first sheet receiving path by coupling the first mounting portion of the main body to the first mounting portion of the sheet post-processing unit. The second discharge path is connected to the second sheet receiving path by coupling the second mounting portion of the main body to the second mounting portion of the sheet post-processing unit. By providing the plurality of mounting portions in the top and side portions of the main body, the sheet post-processing unit can easily be disposed on the top or side of the main body.

17 Claims, 5 Drawing Sheets

IMAGE FORMING APPARATUS HAVING SHEET POST-PROCESSING UNIT

This application is based on application No. 10-255770 filed in Japan, the contents of which is hereby incorporated by reference.

BACKGROUND OF THE INVENTION

1. Field of the Invention

The present invention relates to image forming apparatus and, more particularly, to such an image forming apparatus as a page printer having a sheet post-processing unit such as a sorter or mail bin into which sheets printed by the image forming apparatus are discharged.

2. Description of the Related Art

In a conventional image forming apparatus such as a page printer, a sheet post-processing unit such as a sorter or mail bin for sorting printed recording sheets is connected to the main body of the image forming apparatus, thereby reducing the operation to be performed by the operator. As an example of this type of image forming apparatus, there is one in which a sheet post-processing unit is disposed on and fixed to one side of the main body of the image forming apparatus. In the case of disposing the sheet post-processing unit on the side of the main body of the image forming apparatus, however, an installation area is increased disadvantageously. As an image forming apparatus free from the disadvantage, there has been known one in which the sheet post-processing apparatus is disposed on and fixed to the top of the main body of the image forming apparatus, whereby the installation area is reduced (see, e.g., Japanese Unexamined Patent Publication SHO No. 62-201775, Japanese Unexamined Patent Publication SHO No. 63-160972, and Japanese Unexamined Patent Publication HEI No. 8-208108).

However, the conventional image forming apparatus is allowed to have only one configuration in which the sheet post-processing unit is fixed either to the side or to the top of the main body of the image forming apparatus. In the image forming apparatus, therefore, it is automatically determined whether sheets are discharged with their printed faces facing upward or downward so that a sheet inverting mechanism is required to be switchable between the sheet discharge mode in which the printed faces of discharged sheets face upward and the sheet discharge mode in which the printed faces of discharged sheets face downward. This increases the complexity of the structure, leading to higher cost. In the latter image forming apparatus wherein the sheet post-processing unit is disposed on the top of the main body of the image forming apparatus, if an optional device such as an additional sheet supply cassette is mounted to the bottom, the height of the overall apparatus is increased and the operability of a sheet discharge portion of the sheet post-processing apparatus is degraded, which prevents the apparatus from being placed on a desk.

SUMMARY OF THE INVENTION

The present invention has been achieved in order to solve the above-mentioned problems. It is therefore an object of the present invention to provide an image forming apparatus having a sheet discharge portion with excellent operability, which can be embodied in a proper form in accordance with an installation place. The image forming apparatus is switchable between the configuration in which a sheet post-processing unit is disposed on the top of the main body of the image forming apparatus and the configuration in which the sheet post-processing unit is disposed on the side of the main body of the image forming apparatus such that switching is performed between the sheet discharge mode in which the printed faces of discharged sheets face upward and the sheet discharge mode in which the printed faces of discharged sheets face downward.

To attain the foregoing object, a first feature of the present invention is an image forming apparatus comprising: a main body including, an image forming unit which forms images on sheets, a first discharge path which discharges the image formed sheets, a second discharge path which discharges the image formed sheets, the second discharge path being different from the first discharge path, a first mounting portion and a second mounting portion; and a sheet post-processing unit including, a first sheet receiving path and a second sheet receiving path each connecting to a common sheet transport path, the sheet receiving paths receiving sheets discharged from the main body, a first mounting portion and a second mounting portion; wherein said first discharge path is connected to the first sheet receiving path by coupling the first mounting portion of the main body to the first mounting portion of the sheet post-processing unit, the second discharge path being connected to the second sheet receiving path by coupling the second mounting portion of the main body to the second mounting portion of the sheet post-processing unit.

By way of example, the first and second mounting portions of the main body are provided in the top and side of the main body in an embodiment.

A second feature of the present invention is an image forming apparatus comprising: a first discharge path; a first mounting portion for mounting a sheet post-processing unit, the first mounting portion being disposed corresponding to the first discharge path; a second discharge path; a second mounting portion for mounting the sheet post-processing unit, the second mounting portion being disposed corresponding to the second discharge path; a discharge path selecting member which selects a discharge path from the first and second discharge paths; a detector which detects whether said sheet post-processing unit is mounted on the first mounting portion or the second mounting portion; and a controller which controls the selecting member based on the result of detection by the detector.

A third feature of the present invention is a sheet post-processing apparatus to be connected to the image forming apparatus, the sheet post-processing apparatus comprising: a first receiving path which receives sheets discharged from the image forming apparatus; a first mounting portion which connects with the image forming apparatus, the first mounting portion being disposed corresponding to the first receiving path; a second receiving path which receives sheets discharged from the image forming apparatus; a second mounting portion which connects with the image forming apparatus, the second mounting portion being disposed corresponding to the second receiving path; a transport path which transports sheets inserted via the first and second receiving path; and a tray which accommodates the sheets transported along the transport path.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
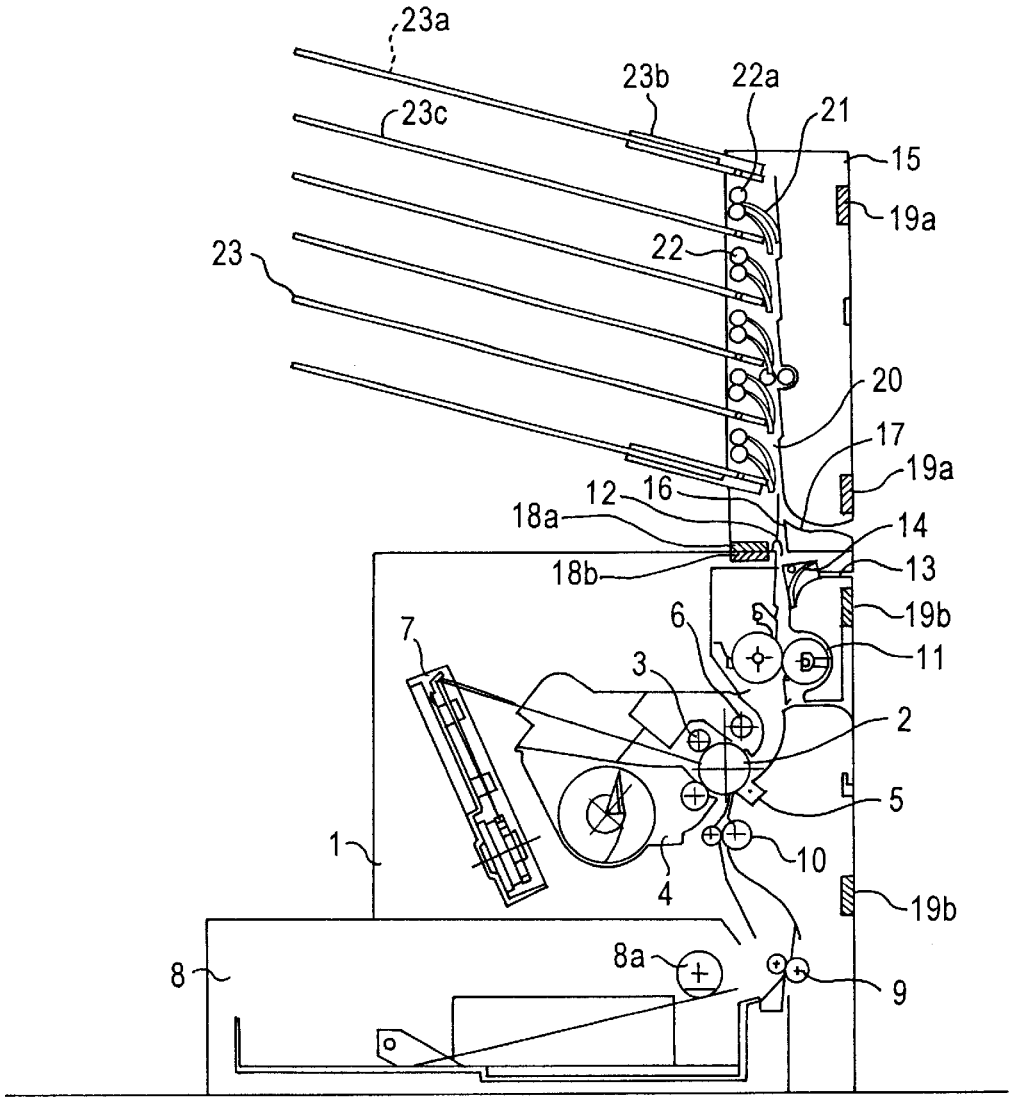
FIG. 1 is a view showing an image forming apparatus with a sheet post-processing unit being disposed on the top of the main body thereof.
Figure 2:
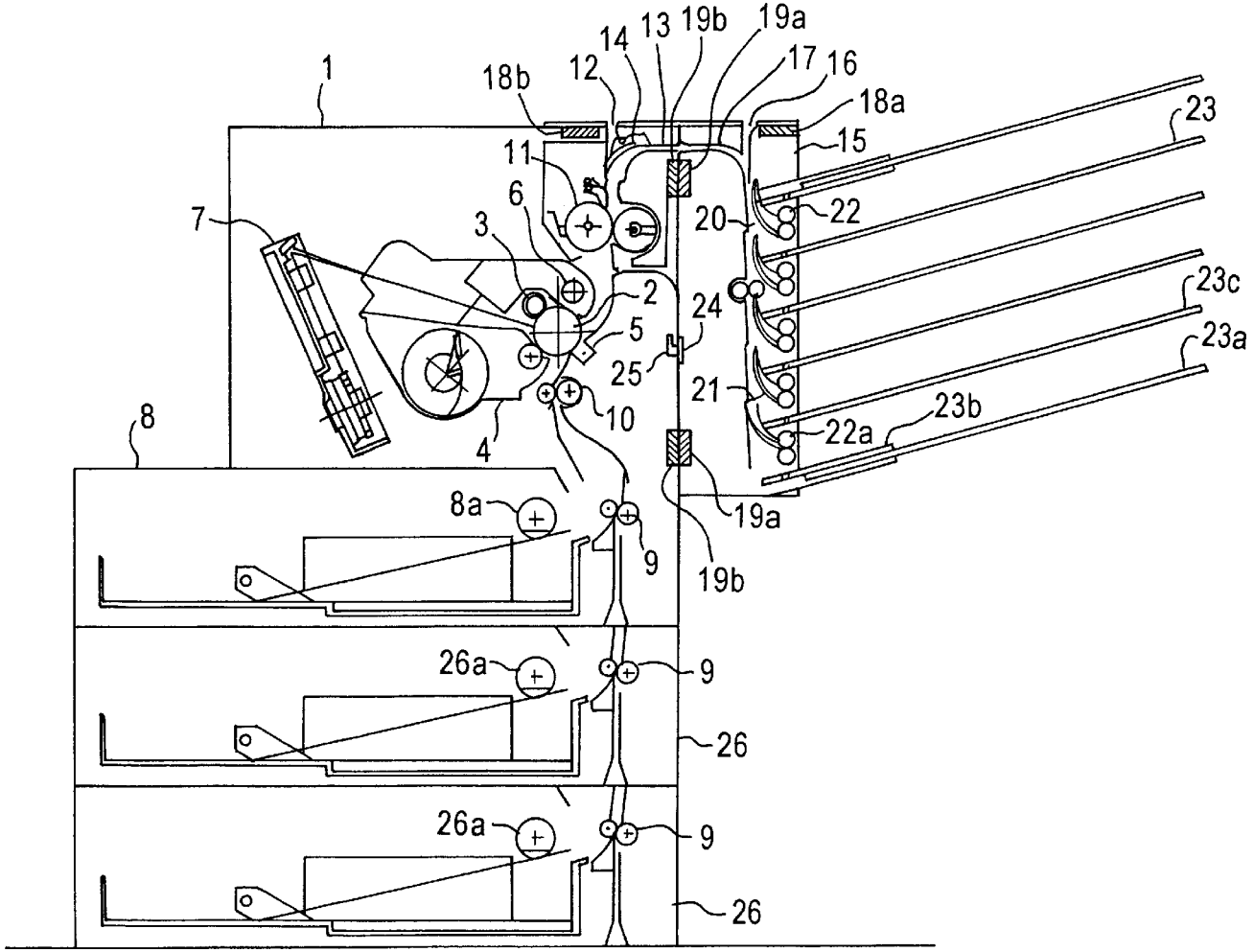
FIG. 2 is a view showing an image forming apparatus with a sheet post-processing unit being disposed on one side of the main body thereof.

Referring now to the drawings, an image forming apparatus according to an embodiment of the present invention will be described. FIG. 1 is a view showing an image forming apparatus with a sheet post-processing unit 15 having a plurality of bins being disposed on the top of the main body 1 thereof. FIG. 2 is a view showing the image forming apparatus with the sheet post-processing unit 15 being disposed on one side of the main body 1 thereof. If the installation area is small and an optional device such as an additional cassette, which will be described later, is not mounted to the bottom of the main body 1 of the image forming apparatus (hereinafter referred to as the main body), the height of the overall apparatus is low, so that a configuration as shown in FIG. 1 is adopted. In the configuration, the operability of the uppermost discharge bin 23 is excellent even when the apparatus is placed on a desk. If an optional device such as an additional cassette, which will be described later, is mounted to the bottom of the main body 1, a configuration as shown in FIG. 2 is adopted. In the configuration, the installation area is increased but the height of the overall apparatus is reduced, so that the operability of the uppermost discharge bin 23 is excellent even when the apparatus is placed on a desk.

Next, a description will be given to the respective basic structures and operations of the main body 1 and sheet post-processing unit 15 (hereinafter referred to as post-processing unit) with reference to FIG. 1. The main body 1 structured as a compact page printer is internally provided with a photosensitive member 2. Around the photosensitive member 2, there are disposed: a charging units 3; a developing unit 4 containing a developing agent; a transfer unit 5; and a cleaning unit 6 which are located in the order named in the direction of rotation of the photosensitive member 2. An exposing unit 7 for forming a latent image on the photosensitive member 2 is disposed at a position between the charging unit 3 and a developing portion of the developing unit 4 where an image can be written with a laser beam. There is also disposed at least one sheet supply cassette 8 having an internal sheet supply element 8*a* on the bottom of the main body 1.

After the surface of the photosensitive member 2 is charged uniformly by means of the charging unit 3, the exposing unit 7 performs the writing of an image to the surface of the photosensitive member 2 with a laser beam so that a toner image is formed on the photosensitive member 2 by using a toner supplied from the developing unit 4. On the other hand, sheets fed from the sheet supply element 8*a* are transported to a resist roller 10 by means of a transport roller 9. The resist roller 10 transports the sheets to the transfer unit 5 in synchronization with the toner image formed on the photosensitive member 2, while adjusting the tip positions of the sheets. Then, the toner image formed on the photosensitive drum 2 is transferred onto the sheets by the transfer unit 5. Thereafter, the toner remaining on the photosensitive drum 2 is cleared by the cleaning unit 6 such that the subsequent image formation is performed. The sheets with the toner image transferred thereon pass through a fixing unit 11 to be fixed and transported to the post-processing unit 15 by passing through a sheet passage path immediately behind the fixing unit 11. In the present embodiment, the sheet passage path is branched to paths 12 and 13 and the sheet passage path to be used is switched therebetween by using a branch gate 14 pivoting around a fulcrum. In the case of FIG. 1, the sheet passage path 12 is selected so that the sheets are transported to a common distribution path 20 within the post-processing unit 15 by passing through the sheet passage path 12 and a sheet passage path 16 of the post-processing unit 15. A plurality of pivoting distribution gates 21 are provided on the distribution path 20. of the distribution gates 21, any one is selected under a direction from a printer controller, which is not shown, to pivot. The sheets are guided to a pair of sheet discharge rollers 22 along the gate 21 and successively discharged from the first page with the printed faces facing downward into the sheet discharge bin 23. It is to be noted that a sheet post-processing unit as described above in such a configuration that the bin into which the sheets are to be discharged is selected under the direction from the controller and the sheets are discharged into the designated bin is termed a mail bin unit.

In the case of FIG. 1, the post-processing unit 15 having the plurality of sheet discharge bins 23 is fastened to the main body 1 in accordance with a common method such as screwing by means of a mounting portion 18*a* provided in the post-processing unit 15 and a mounting portion 18*b* provided in the main body 1. In the post-processing unit 15, a mounting portion 19*a* is provided in addition to the mounting portion 18*a,* while a mounting portion 19*b* is provided in addition to the mounting portion 18*b* in the main body 1. These mounting portions 19*a* and 19*b* are used in the mounting configurations shown in FIG. 2.

In FIG. 2, the post-processing unit 15 is fastened to the main body 1 by means of the mounting portion 19*a* provided in the post-processing unit 15 and the mounting portion 19*b* provided in the main body 1 so that the post-processing unit 15 is disposed on the side of the main body 1. Detecting means consisting of a reed switch 25 provided on the side of the main body 1 and a plate 24 provided on the side of the post-processing unit 15 detects the disposition of the post-processing unit 15 on the side of the main body 1. The sheets fed from the sheet supply cassette 8 or additional cassette 26 by means of the sheet supply elements 8*a,* 26*a* are fixed in the fixing unit 11 through the same printing process as described with reference to FIG. 1. In the process, the foregoing detecting means detects the post-processing unit 15 mounted to the side of the main body 1. The printer controller receives a detect signal from the reed switch 25 to pivot the branch gate 14 so that the sheet passage path is switched to the sheet passage path 13 for side mounting. The sheets having passed through the sheet passage path 13 are transported to the common distribution path 20 through the sheet passage path 17 of the post-processing unit 15 and subsequently discharged into the sheet discharge bin 23 with the printed face facing upward through the same process as described with reference to FIG. 1. In this case, since the printer controller has received the detect signal from the foregoing detecting means and recognized the mounting of the post-processing unit 15 to the side, the printer controller gives an instruction to perform a printing process for collation starting from the last page.

By thus changing the configuration shown in FIG. 1 in which the post-processing unit 15 is disposed on the top of the main body 1 by using the mounting portions 19*a* and 19*b* to the configuration shown in FIG. 2 in which the post-processing unit 15 is disposed on the side of the main body 1, the correspondence between the pairs of sheet discharge rollers 22 and the sheet discharge bins 23 changes. For instance, although the sheet discharge bin 23 corresponding to the pair of sheet discharge rollers 22*a* in the uppermost tier of FIG. 1 is the sheet discharge bin 23*c* in the second tier in the drawing, it becomes the sheet discharge bins 23*a*, 23*b* in the lowermost tier in FIG. 2. Each of the sheet discharge bins 23 in the upper and lowermost tiers, which are used or not used depending on the installation of the post-processing unit 15, is halved into a detachable tip-side bin 23*a* and a base-side bin 23*b*. Since the post-processing unit 15 of FIG. 2 is in the position reached by the post-processing unit 15 of FIG. 1 after performing a 180° vertical rotation, the sheet discharge bins 23 are inclined from the base portions toward the tip portions. Accordingly, the discharged sheets may fall without any modification. The present embodiment has solved the foregoing problem by changing the angles of the sheet discharge bins 23.

Figure 3A:
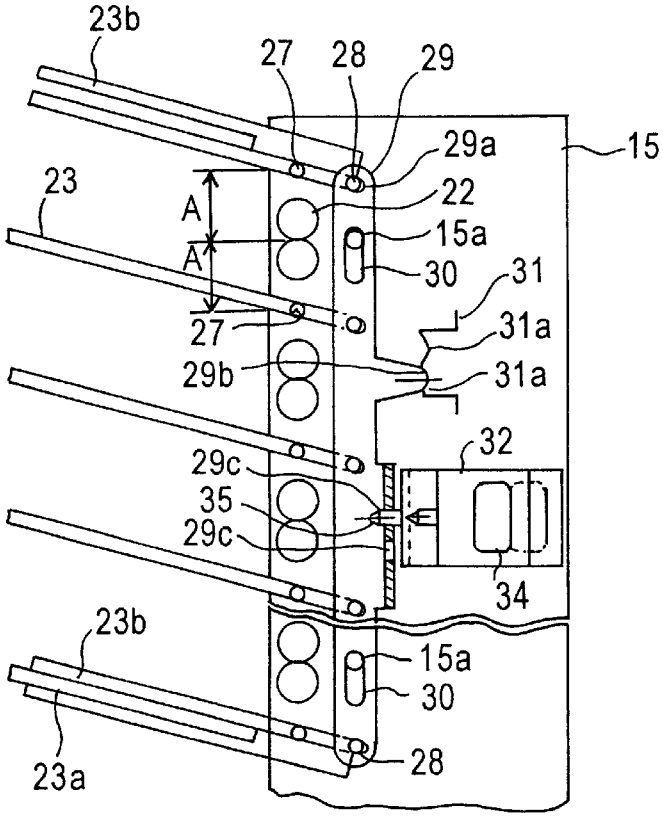
FIGS. 3(*a*) and 3(*b*) are respective views showing in detail a mechanism for changing the angle of sheet discharge bins and a link with the sheet post-processing unit being disposed on the top of the main body of the image forming apparatus.
Figure 3B:
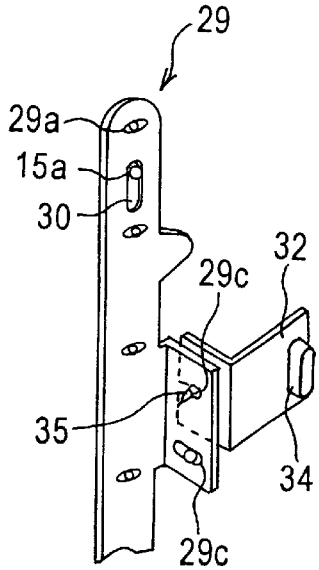
Figure 4:
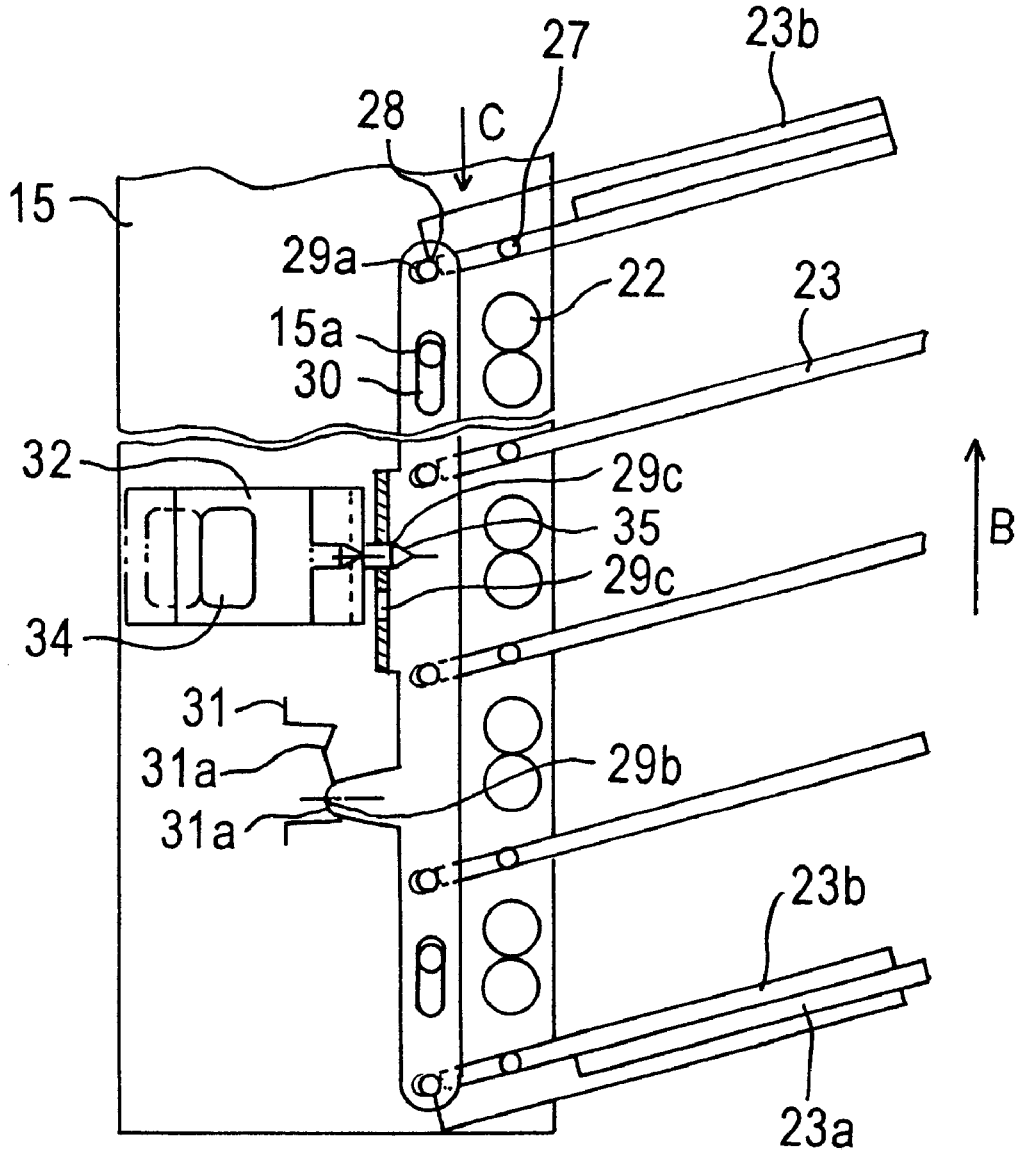
FIG. 4 is a view showing in detail the mechanism for changing the angles of sheet discharge bins with the sheet post-processing unit being disposed on the side of the main body of the image forming apparatus.

Next, a description will be given to a method of changing the angles of the sheet discharge bins 23 with reference to FIGS. 3 and 4. FIGS. 3(*a*) and 3(*b*) are respective views showing in detail a mechanism for changing the angles of sheet discharge bins and a link 29 with the post-processing unit 15 being disposed on the top of the main body 1. FIG. 4 is a view showing in detail the mechanism for changing the angles of sheet discharge bins with the post-processing unit 15 being disposed on the side of the main body 1. Each of the sheet discharge bins 23 is attached rotatably around a fulcrum 27 and connected to a hole 29*a* in the link 29 via a shaft 28 provided at the base-side end of each of the sheet discharge bins 23. Each of shafts 15*a* provided in the post-processing unit 15 is fitted in the corresponding one of elongated holes 30 provided in the link 29. By means of a guide mechanism consisting of the shafts 15*a* and the elongated holes 30, the link 29 is vertically movable relative to the post-processing unit 15. The angles of all the sheet discharge bins 23 change with the vertical movement of the link 29. The link 29 is provided with a plurality of holes 29*c* for fixation. By inserting a pin 35 of a fixture 32 of the post-processing unit 15 into the hole 29*c* for fixation which is compliant with the direction in which the post-processing unit 15 is disposed, the link 29 and the sheet discharge bins 23 are fixed relative to the post-processing unit 15. As shown in FIG. 3(*a*), an equal distance A has been provided between each of the fulcra 27 and the nip portion of the corresponding pair of sheet discharge rollers 22.

When a transition is made from the configuration in which the post-processing unit 15 is disposed on the top of the main body 1 to the configuration in which the post-processing unit 15 is disposed on the side of the main body 1, i.e., when a transition is made to the configuration in which the post-processing unit 15 has been vertically rotated by 180°, a handle 34 provided in the fixture 32 is caused to slide in such a direction as to bring the pin 35 away from the link 29. After the link 29 is placed in a vertically movable condition, one of the plurality of sheet discharge bins 23 is pressed down in the direction indicated by the arrow B. At this time, the sheet discharge bins 23 rotate around the shafts 27 and the ends of the sheet discharge bin 23 closer to the link 29 are pressed down in the direction indicated by the arrow C, so that the link 29 coupled to the sheet discharge bins 23 moves downward. With the movement of the link 29, a click made by a projection 29*b* provided in the link 29 and a depressed portion 31*a* provided in a leaf spring 31 is sensed. At the position at which the click was sensed, the fixture 32 is caused to slide again toward the link 29 and the pin 35 of the fixture 32 is inserted into the hole 29*c* for fixation other than the hole 29*c* for fixation used in FIG. 3, whereby the link 29 and the sheet discharge bins 23 are fastened to the post-processing unit 15. As described above, since an equal distance A has been provided between each of the fulcra 27 and the nip portion of the corresponding pair of sheet discharge rollers 22, the correspondence between the pairs of sheet discharge rollers 22 and the sheet discharge bins 23 in the configuration shown in FIG. 3 can substantially be reproduced even in the configuration shown in FIG. 4. By vertically rotating the post-processing unit 15 by 180°, therefore, stable sheet discharge performance can be obtained even when the correspondence between the pairs of sheet discharge rollers 22 and the sheet discharge bins 23 has changed.

As described above, the switching between the mounting portions to be used allows switching between the configuration in which the post-processing unit 15 is disposed on the top of the main body 1 and the configuration in which the post-processing unit 15 is disposed on the side of the main body 1. In the case where the installation area is small, therefore, the whole apparatus can be installed easily by adopting the configuration in which the post-processing unit 15 is disposed on the top of the main body 1. In the case where an optional device such as an additional sheet supply cassette 26 is mounted to the bottom, on the other hand, the operability of the upper part of the sheet discharge portion of the post-processing unit 15 can be improved by adopting the configuration in which the post-processing unit 15 is disposed on the side of the main body 1. Moreover, since it is possible to switch the discharge path and sheet receptacle to be used depending on the positional relationship between the main body 1 and the post processing unit 15, the orientation of the printed faces of the sheets when they are discharged can be switched between the upper side and the lower side in response to the user's needs by changing the positional relationship between the main body 1 and the post-processing unit 15 as long as there is no limit to the height and area of an installation place.

Figure 5B:
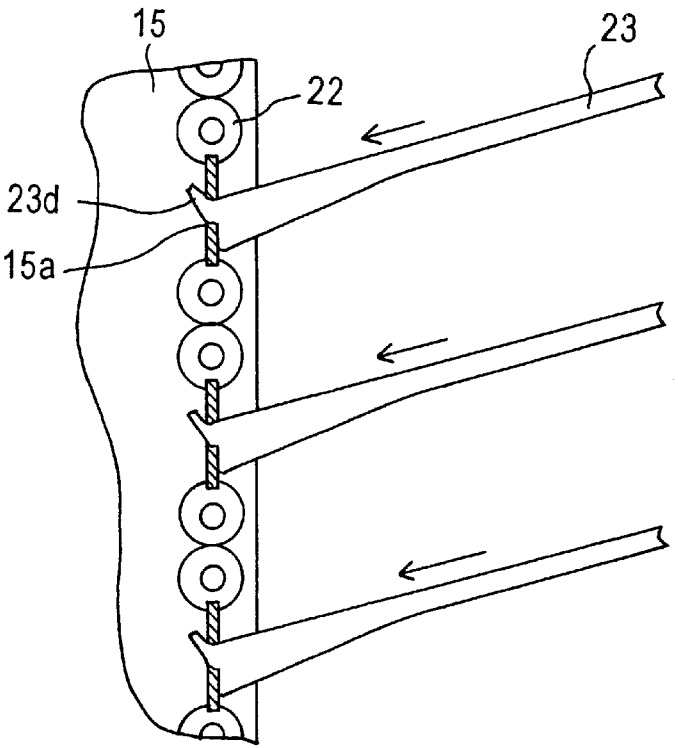
FIGS. 5(*a*) and 5(*b*) are respective views showing the mounting of the sheet discharge bins in the cases where the sheet post-processing unit is disposed on the top and side of the main body of the image forming apparatus.
Figure 5A:
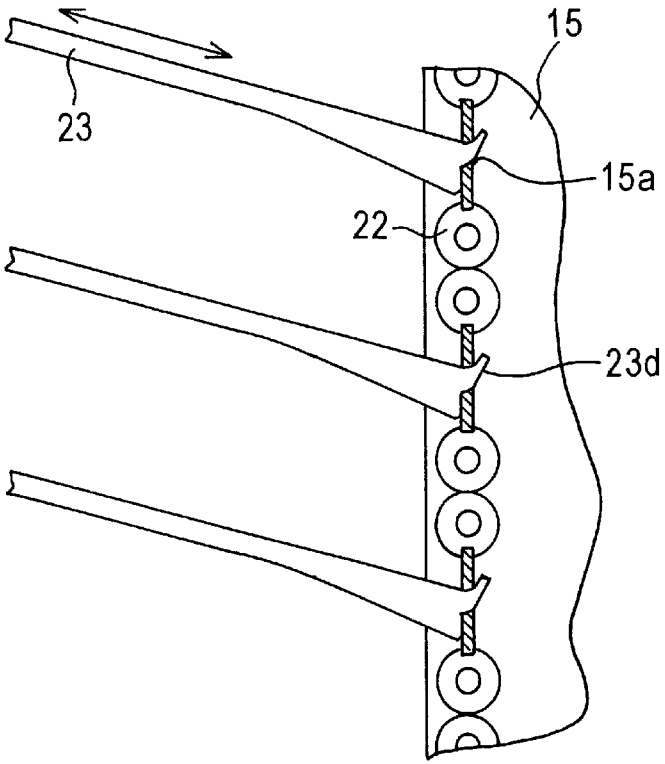

The present invention is not limited to the foregoing embodiment but can be embodied in various other forms. For example, although the foregoing embodiment prevents the discharged sheets from falling down by changing the angles of the sheet discharge bins 23 when the correspondence between the pairs of sheet discharge roller 2 and the sheet discharge bins 23 is changed, it is also possible to prevent the discharged sheets from falling down by adapting the sheet discharge bins 23 such that they are detachable from the post-processing unit 15 as shown in FIGS. 5(*a*) and 5(*b*), engaging engagement clicks 23*d* provided in the sheet discharge bins 23 with holes 15*a* provided in the post-processing unit 15, and attaching again the sheet discharge bins 23 by inverting the vertical orientation thereof when the configuration in which the post-processing unit 15 is disposed on the top of the main body 1 shown in FIG. 5(*a*) is changed to the configuration in which the post-processing unit 15 is disposed on the side of the main body 1 shown in FIG. 5(*b*).

Although the present embodiment has shown the post-processing unit 15 having the plurality of sheet discharge bins 23, a shift tray or finisher having only one bin may also be used appropriately as the post-processing unit 15. Alternatively, a post-processing unit 15 which performs any post-processing, such as sheet folding, with respect to sheets such that they are discharged or accommodated may be used satisfactorily as the post-processing unit 15. Alternatively, it is also possible to mount another type of sheet post-processing unit by using the sheet passage path and mounting portion of the main body 1 which are unassigned. There may also be mounted an inversion path for switching between the sheet discharge mode in which the printed faces of discharged sheets face upward and the sheet discharge mode in which the printed faces of discharged sheets face downward or an inversion path for double-face printing. Although the present embodiment has shown the application of the present invention to an image forming apparatus structured as a compact page printer, the present invention is also applicable to another image forming apparatus such as a copier or facsimile.

Thus, according to the present invention, the combination of the mounting portions to be used and the combination of the discharge path and sheet receptacle to be used can be changed depending on the positional relationship between the main body of the image forming apparatus and the sheet post-processing unit. This allows switching between the configuration in which the post-processing apparatus is disposed on the top of the main body of the image forming apparatus and the configuration in which the post-processing apparatus is disposed on the side of the main body of the image forming apparatus so that the image forming apparatus having a simple structure is usable at low cost. Moreover, the orientation of the printed faces of sheets can be switched between the upper side and the lower side without using a sheet inversion mechanism. If the installation area is small, the apparatus can be disposed easily by switching to the configuration in which the sheet post-processing unit is disposed on the top of the main body of the image forming apparatus. If an optional device such as an additional sheet supply cassette is mounted to the bottom, the operability of the upper part of the sheet discharge portion of the sheet post-processing unit can be improved by switching to the configuration in which the sheet post-processing unit is disposed on the side of the main body of the image forming apparatus.

By providing the plurality of mounting portions in the top and side portions of the main body of the image forming apparatus, the sheet post-processing unit can easily be disposed on the top or side of the main body of the image forming apparatus and the foregoing effect can be achieved more positively.

By using the sheet post-processing unit comprising a plurality of sheet discharge bins and a plurality of sheet discharge rollers provided for the individual sheet discharge bins and changing the correspondence between the sheet discharge rollers and the sheet discharge bins in response to a change in the positional relationship between the main body of the image forming apparatus and the sheet post-processing unit, the sheets discharged by the sheet discharge rollers can be contained in the sheet discharge bins without any difficulty even if the positional relationship between the main body of the image forming apparatus and the sheet post-processing unit changes.

In the case described above, if the positional relationship between the main body of the image forming apparatus and the sheet post-processing unit changes, the sheets discharged from the sheet discharge rollers are prevented from falling down by properly changing the angles of the sheet discharge bins relative to the sheet discharge rollers in response to a change in the correspondence between the sheet discharge rollers and the sheet discharge bins. In addition, stable sheet discharge performance can be maintained.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An image forming apparatus comprising:

a main body including, an image forming unit which forms images on sheets, a first discharge path which discharges the image formed sheets, a second discharge path which discharges the image formed sheets, the second discharge path being different from the first discharge path, and a first mounting portion and a second mounting portion; and a sheet post-processing unit including, a first sheet receiving path and a second sheet receiving path each connecting to a common sheet transport path, the sheet receiving paths receiving sheets discharged from the main body, and a first mounting portion and a second mounting portion;

wherein said first discharge path is connected to the first sheet receiving path by coupling the first mounting portion of the main body to the first mounting portion of the sheet post-processing unit, the second discharge path being connected to the second sheet receiving path by coupling the second mounting portion of the main body to the second mounting portion of the sheet post-processing unit.

2. The image forming apparatus as claimed in claim 1, wherein said first mounting portion of the main body is provided in the top of the main body, said second mounting portion of the main body being provided in a side of the main body.

3. The image forming apparatus as claimed in claim 1, wherein said sheet post-processing unit includes a plurality of sheet discharge bins and a plurality of sheet discharge rollers provided for the individual sheet-discharge bins, a correspondence between the sheet discharge rollers and the sheet discharge bins being changed depending on a position of the sheet post-processing unit mounted to the main body.

4. The image forming apparatus as claimed in claim 1, wherein said sheet post-processing unit includes at least one sheet discharge bin.

5. The image forming apparatus as claimed in claim 4, wherein said sheet post-processing unit includes a changing mechanism which changes an angle of said sheet discharge bin depending on a position of the sheet post-processing unit mounted to the main body.

6. The image forming apparatus as claimed in claim 4, wherein said sheet post-processing unit discharges sheets on said sheet discharge bin so that an image formed surface of the sheet is down when the sheet post-processing unit is mounted on the first mounting portion, and discharges sheets so that the image formed surface of the sheet is up when the sheet post-processing unit is mounted on the second mounting portion.

7. The image forming apparatus as claimed in claim 1, wherein said main body includes a detector which detects whether said sheet post-processing unit is mounted on the first mounting portion or the second mounting portion.

8. The image forming apparatus as claimed in claim 7, wherein said main body includes a discharge path selecting member which selects a discharge path from the first and second discharge paths, and a controller which controls the discharge path selecting member based on the detection result by said detector.

9. The image forming apparatus as claimed in claim 7, wherein said main body includes a discharge order controller which switches whether the sheets are discharged from the first page or the final page based on the result of detection by the detector.

10. The image forming apparatus comprising:

a first discharge path;

a first mounting portion for mounting a sheet post-processing unit, the first mounting portion being disposed corresponding to the first discharge path;

a second discharge path;

a second mounting portion for mounting the sheet post-processing unit, the second mounting portion being disposed corresponding to the second discharge path;

a discharge path selecting member which selects a discharge path from the first and second discharge paths;

a detector which detects whether said sheet post-processing unit is mounted on the first mounting portion or the second mounting portion; and a controller which controls the selecting member based on the result of detection by the detector.

11. The image forming apparatus as claimed in claim 10, further comprising:

a discharge order controller which switches the order of discharging sheets between the sequence in which the sheets are discharged from the first page and the sequence in which the sheets are discharged from the final page based on the result of detection by the detector.

12. The image forming apparatus as claimed in claim 10, wherein said first mounting portion of the main body is provided in the top of the main body, said second mounting portion of the main body being provided in the top of it.

13. A sheet post-processing apparatus to be connected to an image forming apparatus, comprising:

a first receiving path which receives sheets discharged from the image forming apparatus;

a first mounting portion which connects with the image forming apparatus, the first mounting portion being disposed corresponding to the first receiving path;

a second receiving path which receives sheets discharged from the image forming apparatus;

a second mounting portion which connects with the image forming apparatus, the second mounting portion being disposed corresponding to the second receiving path;

a transport path which transports sheets inserted via the first and second receiving path; and a tray which accommodates the sheets transported along the transport path.

14. The sheet post-processing apparatus as claimed in claim 13, further comprising:

a plurality of trays; and a plurality of sheet discharge rollers provided for the individual trays, wherein a correspondence between the sheet discharge rollers and the trays is changed depending on a mounting position of the sheet post-processing apparatus mounted to the image forming apparatus.

15. A sheet post-processing apparatus as claimed in claim 13, further comprising:

a changing mechanism which changes an angle of said tray depending on a mounting position of the sheet post-processing apparatus mounted to the image forming apparatus.

16. The image forming apparatus as claimed in claim 1, wherein the first mounting portion of the sheet post-processing unit is on a first side of the sheet post-processing unit and the second mounting portion of the sheet post-processing unit is on a second side of the sheet post-processing unit, different from the first side.

17. The image forming apparatus as claimed in claim 1, wherein a position of the sheet post processing unit when the first discharge path is connected to the first sheet receiving path differs from the position of the sheet post processing unit when the second discharge path is connected to the second sheet receiving path by a 180° vertical rotation.

* * * * *